US007935465B2

(12) United States Patent
De Jong et al.

(10) Patent No.: US 7,935,465 B2
(45) Date of Patent: May 3, 2011

(54) SELF LUBRICATING PHOTORECEPTOR

(75) Inventors: Kathy L. De Jong, London (CA); Nan-Xing Hu, Oakville (CA); Giuseppa Baranyi, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 601 days.

(21) Appl. No.: 12/041,173

(22) Filed: Mar. 3, 2008

(65) Prior Publication Data

US 2009/0220876 A1 Sep. 3, 2009

(51) Int. Cl.
*G03G 5/147* (2006.01)

(52) U.S. Cl. ..... 430/57.1; 430/58.65; 430/59.4; 430/59.6; 430/66; 430/96

(58) Field of Classification Search ..... 430/57.1, 430/58.65, 59.4, 59.6, 66, 96
See application file for complete search history.

(56) References Cited

U.S. PATENT DOCUMENTS

| | | | | |
|---|---|---|---|---|
| 3,121,006 | A | 2/1964 | Middleton et al. | |
| 4,286,033 | A | 8/1981 | Neyhart et al. | |
| 4,291,110 | A | 9/1981 | Lee | |
| 4,338,387 | A | 7/1982 | Hewitt | |
| 4,457,994 | A | 7/1984 | Pai et al. | |
| 4,871,634 | A | 10/1989 | Limburg et al. | |
| 5,702,854 | A | 12/1997 | Schank et al. | |
| 5,976,744 | A | 11/1999 | Fuller et al. | |
| 2005/0233231 | A1 * | 10/2005 | Qi et al. | 430/58.65 |
| 2006/0105264 | A1 | 5/2006 | Dinh et al. | |
| 2007/0020005 | A1 * | 1/2007 | Shigezaki et al. | 399/349 |
| 2007/0072101 | A1 | 3/2007 | Dinh et al. | |
| 2007/0134573 | A1 | 6/2007 | Yanus et al. | |
| 2008/0160438 | A1 | 7/2008 | Nishina et al. | |

FOREIGN PATENT DOCUMENTS

| | | | |
|---|---|---|---|
| JP | 2006259168 | * | 9/2006 |
| WO | WO 2006/030618 A1 | | 3/2006 |

OTHER PUBLICATIONS

Abstract of JP-2006259168, Sep. 2006.*
Machine English language translation of JP-2006259168, Sep. 2006.*
Abstract of JP-60031146, Feb. 1985.*

* cited by examiner

*Primary Examiner* — Hoa V Le
(74) *Attorney, Agent, or Firm* — Oliff & Berridge, PLC

(57) ABSTRACT

Disclosed is an electrophotographic imaging member that includes a lubricant delivering coating having a polymer matrix, a charge transport component, and a lubricant encapsulated within nano- or microcapsules. Also disclosed is an imaging forming apparatus including a charging device, a toner developer device, a cleaning device, and a photoreceptor having a conductive substrate, a charge generating layer, a charge transport layer, and an optional overcoat layer, such that the outmost layer of the photoreceptor contains a lubricant encapsulated within nano- or microcapsules. Additionally provided is a method of forming an image with the disclosed electrophotographic imaging member.

18 Claims, 1 Drawing Sheet

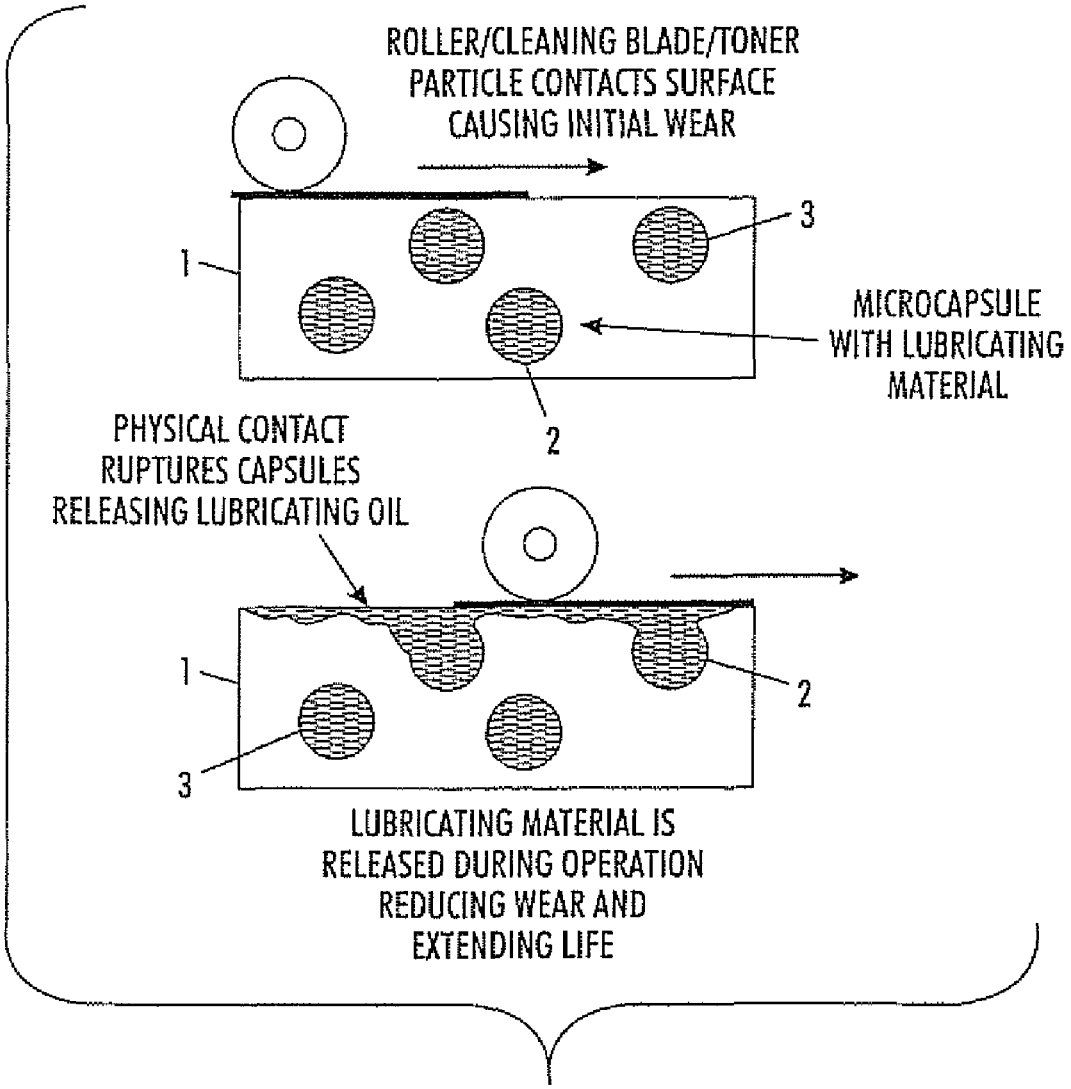
FIGURE

SELF LUBRICATING PHOTORECEPTOR

TECHNICAL FIELD

This disclosure is generally directed to electrophotographic imaging members and, more specifically, to layered photoreceptor structures comprising a layer composition that is capable of self-lubrication. This disclosure also relates to processes for making and using the imaging members.

REFERENCES

U.S. Pat. No. 5,702,854 describes an electrophotographic imaging member including a supporting substrate coated with at least a charge generating layer, a charge transport layer and an overcoating layer, said overcoating layer comprising a dihydroxy arylamine dissolved or molecularly dispersed in a crosslinked polyamide matrix. The overcoating layer is formed by crosslinking a crosslinkable coating composition including a polyamide containing methoxy methyl groups attached to amide nitrogen atoms, a crosslinking catalyst and a dihydroxy amine, and heating the coating to crosslink the polyamide. The electrophotographic imaging member may be imaged in a process involving uniformly charging the imaging member, exposing the imaging member with activating radiation in image configuration to form an electrostatic latent image, developing the latent image with toner particles to form a toner image, and transferring the toner image to a receiving member.

U.S. Pat. No. 5,976,744 discloses an electrophotographic imaging member including a supporting substrate coated with at least one photoconductive layer, and an overcoating layer, the overcoating layer including a hydroxy functionalized aromatic diamine and a hydroxy functionalized triarylamine dissolved or molecularly dispersed in a crosslinked acrylated polyamide matrix, the hydroxy functionalized triarylamine being a compound different from the polyhydroxy functionalized aromatic diamine. The overcoating layer is formed by coating.

U.S. patent application Ser. No. 11/234,275 filed Sep. 26, 2005, discloses an electrophotographic imaging member comprising a substrate, a charge generating layer, a charge transport layer, and an overcoating layer, said overcoating layer comprising a cured polyester polyol or cured acrylated polyol film-forming resin and a charge transport material.

U.S. patent application Ser. No. 11/275,134 filed Dec. 13, 2005, discloses an electrophotographic imaging member comprising a substrate, a charge generating layer, a charge transport layer, and an overcoating layer, said overcoating layer comprising a terphenyl arylamine dissolved or molecularly dispersed in a polymer binder.

U.S. patent application Ser. No. 10/992,913 filed Nov. 18, 2004, discloses a process for preparing an overcoat for an imaging member, said imagine member comprising a substrate, a charge transport layer, and an overcoat positioned on said charge transport layer, wherein said process comprises: a) adding and reacting a prepolymer comprising a reactive group selected from the group consisting of hydroxyl, carboxylic acid and amide groups, a melamine formaldehyde crosslinking agent, an acid catalyst, and an alcohol-soluble small molecule to form an overcoat solution; and b) subsequently providing said overcoat solution onto said charge transport layer to form an overcoat layer.

Phenolic overcoat compositions comprising a phenolic resin and a triarylamine hole transport molecule are known. These phenolic overcoat compositions can be cured to form a crosslinked structure.

Disclosed in U.S. Pat. No. 4,871,634 is an electrostatographic imaging member containing at least one electrophotoconductive layer. The imaging member comprises a photogenerating material and a hydroxy arylamine compound represented by a certain formula. The hydroxy arylamine compound can be used in an overcoat with the hydroxy arylamine compound bonded to a resin capable of hydrogen bonding such as a polyamide possessing alcohol solubility.

Disclosed in U.S. Pat. No. 4,457,994 is a layered photosensitive member comprising a generator layer and a transport layer containing a diamine type molecule dispersed in a polymeric binder, and an overcoat containing triphenyl methane molecules dispersed in a polymeric binder.

The disclosures of each of the foregoing patents are hereby incorporated by reference herein in their entireties. The appropriate components and process aspects of the each of the foregoing patents may also be selected for the present compositions and processes in embodiments thereof.

BACKGROUND

In electrophotography, also known as Xerography, electrophotographic imaging or electrostatographic imaging, the surface of an electrophotographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light. The radiation selectively dissipates the charge on the illuminated areas of the photoconductive insulating layer while leaving behind an electrostatic latent image on the non-illuminated areas. This electrostatic latent image may then be developed to form a visible image by depositing finely divided electroscopic marking particles on the surface of the photoconductive insulating layer. The resulting visible image may then be transferred from the imaging member directly or indirectly (such as by a transfer or other member) to a print substrate, such as transparency or paper. The surface of the imaging member is then cleaned by a cleaning unit, such as a cleaning blade, to removal any residual marking particles before next printing cycle. The imaging process may be repeated many times with reusable imaging members. In order to maintain a clean surface for each print cycle, a cleaning unit, such as a cleaning blade may be incorporated.

Although excellent toner images may be obtained with multilayered belt or drum photoreceptors, it has been found that as more advanced, higher speed electrophotographic copiers, duplicators, and printers are developed, there is a greater demand on print quality and useful life. Improved photoreceptor designs must target higher sensitivity, faster discharge, mechanical robustness, and ease cleaning. The delicate balance in charging image and bias potentials, and characteristics of the toner and/or developer must also be maintained. This places additional constraints on the quality of photoreceptor manufacturing, and thus on the manufacturing yield.

Imaging members are generally exposed to repetitive electrophotographic cycling, which subjects the exposed charged transport layer or alternative top layer thereof to mechanical abrasion, high friction with cleaning blade, and chemical attack from the charging device. This repetitive cycling leads to gradual deterioration in the mechanical and electrical characteristics of the exposed charge transport layer.

Providing a protective overcoat layer is a conventional means of extending the useful life of photoreceptors. An illustrative example of protective overcoats may include a cured composition formed from (i) a polyol binder, (ii) a melamine-formaldehyde curing agent; (iii) a hole transport material; (iv) an acid catalyst; and (v) a leveling agent coated from an alcoholic solution.

In conventional photoreceptors, mechanical wear due to cleaning blade contact or scratches due to carrier beads or contact with paper, causes photoreceptor devices to fail, and it may not be feasible to continue adding layers to improve photoreceptor robustness and therefore there is a need to develop new materials and systems that will respond and correct material breakdown as it occurs.

Despite the various approaches that have been taken for forming imagine members there remains a need for improved imaging member design, to provide improved imaging performance and longer lifetime, reduce its friction with cleaning blade, and minimize the frequency for maintenance, and the like.

SUMMARY

This disclosure addresses some or all of the above described problems and also provides materials and methods for improved abrasion wear resistance, reduced friction, and longer lifetime, and the like of electrophotographic photoreceptors. This is generally accomplished by using a layer composition that is capable of self-lubrication or a lubricant delivering coating. In embodiments, self lubricating materials may be encapsulated in the photoreceptor such that ruptures in the capsules release the lubricating material. This disclosure also relates to processes for making and using the imaging members.

In an embodiment, the present disclosure provides a photoconductive member comprised of a lubricant delivering coating comprising a polymer matrix, a charge transport component, and a lubricant encapsulated within nano- or microcapsules.

In another embodiment, the present disclosure provides an imaging forming apparatus comprising a charging device, a toner developer device, a cleaning device, and a photoreceptor comprising a conductive substrate, a charge generating layer, a charge transport layer, and an optional overcoat layer, wherein the outmost layer of the photoreceptor contains a lubricant encapsulated within nano- or microcapsules.

The present disclosure also provides electrophotographic image development devices comprising such electrophotographic imagine members. Also provided are imaging processes using such electrophotographic imaging members

BRIEF DESCRIPTION OF THE DRAWINGS

The FIGURE is an illustration of self-lubrication processes of the Examples of the disclosure.

DETAILED DESCRIPTION

The present disclosure relates generally to photoconductive imaging members such as photoconductors, photoreceptors and the like, for example that may be used in electrophotographic or xerographic imaging processes. The photoconductive imagine members include at least one layer having a composition that makes the photoreceptor capable of self-lubrication, or the encapsulation of lubricating material which, in the event of mechanical wear of the photoreceptor, ruptures the capsules and releases the lubricating material contained within.

Electrophotographic imaging members are known in the art. Electrophotographic imagine members may be prepared by any suitable technique. Typically, a flexible or rigid substrate is provided with an electrically conductive surface. A charge generating layer is then applied to the electrically conductive surface. A charge blocking layer may optionally be applied to the electrically conductive surface prior to the application of a charge generating layer. If desired, an adhesive layer may be utilized between the charge blocking layer and the charge generating layer. Usually the charge generation layer is applied onto the blocking layer and a hole or charge transport layer is formed on the charge generation layer, followed by an optional overcoat layer. This structure may have the charge generation layer on top of or below the hole or charge transport layer. In embodiments, the charge generating layer and hole or charge transport layer can be combined into a single active layer that performs both charge generating and hole transport functions.

The substrate may be opaque or substantially transparent and may comprise any suitable material having the mechanical properties. Accordingly, the substrate may comprise a layer of an electrically non-conductive or conductive material such as an inorganic or an organic composition. As electrically non-conducting materials there may be employed various resins known for this purpose including polyesters, polycarbonates, polyamides, polyurethanes, and the like which are flexible as thin webs. An electrically conducting substrate may be any metal, for example, aluminum, nickel, steel, copper, and the like or a polymeric material, as described above, filled with an electrically conducting substance, such as carbon, metallic powder, and the like or an organic electrically conducting material. The electrically insulating or conductive substrate may be in the form of an endless flexible belt, a web, a rigid cylinder, a sheet and the like. The thickness of the substrate layer depends on numerous factors, including strength desired and economical considerations. Thus, for a drum, this layer may be of substantial thickness of, for example, up to many centimeters or of a minimum thickness of less than a millimeter. Similarly, a flexible belt may be of substantial thickness, for example, about 250 micrometers, or of minimum thickness less than 50 micrometers, provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors. Accordingly, for a flexible photoresponsive imaging device, the thickness of the conductive coating may be about 20 angstroms to about 750 angstroms, such as about 100 angstroms to about 200 angstroms for an optimum combination of electrical conductivity, flexibility and light transmission. The flexible conductive coating may be an electrically conductive metal layer formed, for example, on the substrate by any suitable coating technique, such as a vacuum depositing technique or electrodeposition. Typical metals include aluminum, zirconium, niobium, tantalum, vanadium and hafnium, titanium, nickel, stainless steel, chromium, tungsten, molybdenum, and the like.

Illustrative examples of substrates are as illustrated herein, and more specifically layers selected for the imaging members of the present disclosure, and which substrates can be opaque or substantially transparent comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass, or the like. The substrate may be flexible, seamless, or rigid, and may have a number of different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®, a polycarbonate resin having a weight average molecular weight of from about 50,000 to about 100,000, commercially available from Farbenfabriken Bayer A.G., or similar resin.

The thickness of the photoconductor substrate layer depends on many factors, including economical considerations, electrical characteristics, number of layers, components in each of the layers, and the like, thus this layer may be of substantial thickness, for example over about 3,000 microns, and more specifically the thickness of this layer can be from about 1,000 to about 3,000 microns, from about 100 to about 1,000 microns or from about 300 to about 700 microns, or of a minimum thickness. In embodiments, the thickness of this layer is from about 75 microns to about 300 microns, or from about 100 to about 150 microns.

A charge blocking layer or hole blocking layer may optionally be applied to the electrically conductive surface prior to the application of a photogenerating layer. When desired, an adhesive layer may be included between the charge blocking layer the hole blocking layer or interfacial layer and the photogenerating layer. Usually, the photogenerating layer is applied onto the blocking layer and a charge transport layer or plurality of charge transport layers are formed on the photogenerating layer. This structure may have the photogenerating layer on top of or below the charge transport layer.

The hole blocking or undercoat layers for the imaging members of the present disclosure can contain a number of components including known hole blocking components. A suitable hole blocking layer may be comprised of polymers such as polyvinyl butyral, epoxy resins, polyesters, polysiloxanes, polyamides, polyurethanes, and the like, nitrogen-containing siloxanes or nitrogen-containing titanium compounds, such as trimethoxysilyl propyl ethylene diamine, N-beta (aminoethyl) gamma-aminopropyl trimethoxy silane, isopropyl 4-aminobenzene sulfonyl titanate, di(dodecylbenezene sulfonyl) titanate, isopropyl di(4-aminobenzoyl) isostearoyl titanate, isopropyl tri(N-ethyl amino) titanate, isopropyl trianthranil titanate, isopropyl tri(N,N-dimethyl-ethyl amino) titanate, titanium-4-amino benzene sulfonate oxyacetate, titanium 4-aminobenzoate isostearate oxyacetate, gamma-aminobutyl methyl dimethoxy silane, gamma-aminopropyl methyl dimethoxy silane, and gamma-aminopropyl trimethoxy silane, for example as disclosed in U.S. Pat. Nos. 4,338,387, 4,286,033 and 4,291,110, each incorporated herein by reference in their entireties.

The hole blocking layer can also be, for example, comprised of from about 20 weight percent to about 80 weight percent, and more specifically, from about 55 weight percent to about 65 weight percent of a suitable component like a metal oxide, such as $TiO_2$, from about 20 weight percent to about 70 weight percent, and more specifically, from about 25 weight percent to about 50 weight percent of a phenolic resin; from about 2 weight percent to about 20 weight percent and, more specifically, from about 5 weight percent to about 15 weight percent of a phenolic compound containing at least two phenolic groups, such as bisphenol S, and from about 2 weight percent to about 15 weight percent, and more specifically, from about 4 weight percent to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9. To the above dispersion are added a phenolic compound and dopant followed by mixing. The hole blocking layer coating dispersion can be applied by dip coating or web coating, and the layer can be thermally cured after coating. The hole blocking layer resulting is, for example, of a thickness of from about 0.01 micron to about 30 microns, and more specifically, from about 0.1 micron to about 8 microns. Examples of phenolic resins include formaldehyde polymers with phenol, p-tert-butylphenol, cresol, such as VARCUM™ 29159 and 29101 (available from OxyChem Company), and DURITE™ 97 (available from Borden Chemical); formaldehyde polymers with ammonia, cresol and phenol, such as VARCUM™ 29112 (available from OxyChem Company); formaldehyde polymers with 4,4'-(1-methylethylidene)bisphenol, such as VARCUM™ 29108 and 29116 (available from OxyChem Company); formaldehyde polymers with cresol and phenol, such as VARCUM™ 29457 (available from OxyChem Company), DURITE™ SD-423A, SD-422A (available from Borden Chemical); or formaldehyde polymers with phenol and p-tert-butylphenol, such as DURITE™ ESD 556C (available from Border Chemical).

The optional hole blocking layer may be applied to the substrate. Any suitable and conventional blocking layer capable of forming an electronic barrier to holes between the adjacent photoconductive layer (or electrophotographic imaging layer) and the underlying conductive surface of substrate may be selected.

The optional hole blocking or undercoat layers for the imaging members of the present disclosure can contain a number of components including known hole blocking components, such as amino silanes, doped metal oxides, a metal oxide like titanium, chromium, zinc, tin and the like; a mixture of phenolic compounds and a phenolic resin or a mixture of two phenolic resins, and optionally a dopant such as $SiO_2$. The phenolic compounds usually contain at least two phenol groups, such as bisphenol A (4,4'-isopropylidenediphenol), E (4,4'-ethylidenebisphenol), F (bis(4-hydroxyphenyl)methane), M (4,4'-(1,3-phenylenediisopropylidene)bisphenol), P (4,4'-(1,4-phenylene diisopropylidene)bisphenol), S (4,4'-sulfonyldiphenol), and Z (4,4'-cyclohexylidenebisphenol); hexafluorobisphenol A (4,4'-(hexafluoro isopropylidene) diphenol), resorcinol, hydroxyquinone, catechin, and the like.

In embodiments, a suitable known adhesive layer can be included in the photoconductor. Typical adhesive layer materials include, for example, polyesters, polyurethanes, and the like. The adhesive layer thickness can vary and in embodiments is, for example, from about 0.05 micrometer (500 Angstroms) to about 0.3 micrometer (3,000 Angstroms). The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying and the like.

As optional adhesive layers usually in contact with or situated between the hole blocking layer and the photogenerating layer, there can be selected various known substances inclusive of copolyesters, polyamides, poly(vinyl butyral), poly (vinyl alcohol), polyurethane and polyacrylonitrile. This layer is, for example, of a thickness of from about 0.001 micron to about 1 micron, or from about 0.1 to about 0.5 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure further desirable electrical and optical properties.

The photogenerating layer in embodiments is comprised of, for example, about 60 weight percent of Type V hydroxygallium phthalocyanine or chlorogallium phthalocyanine, and about 40 weight percent of a resin binder like poly (vinyl chloride-co-vinyl acetate) copolymer, such as VMCH (available from Dow Chemical). Generally, the photogenerating layer can contain known photogenerating pigments, such as metal phthalocyanines, metal free phthalocyanines, alkylhydroxyl gallium phthalocyanines, hydroxygallium phthalocyanines, chlorogallium phthalocyanines, perylenes, especially bis(benzimidazo)perylene, titanyl phthalocyanines, and the like, and more specifically, vanadyl phthalocyanines, Type V hydroxygallium phthalocyanines, and inorganic components such as selenium, selenium alloys, and trigonal selenium. In embodiments, titanium oxide phthalocyanine may be used as a photogenerating pigment. The photogenerating pigment can be dispersed in a resin binder similar to the resin binders selected for the charge transport layer, or alternatively no resin binder need be present. Generally, the thickness of the photogenerating layer depends on a number of factors, including the thicknesses of the other layers and the amount of photogenerating material contained in the photo generating layer. Accordingly, this layer can be of a thickness of, for example, from about 0.05 micron to about 10 microns, and more specifically, from about 0.25 micron to about 2 microns when, for example, the photogenerating compositions are present in an amount of from about 30 to about 75 percent by volume. The maximum thickness of this layer in embodiments is dependent primarily upon factors, such as photosensitivity, electrical properties and mechanical considerations. The photogenerating layer binder resin is present in various suitable amounts, for example from about 1 to about 50, and more specifically, from about 1 to about 10 weight percent, and which resin may be selected from a number of known polymers, such as poly(vinyl butyral), poly(vinyl carbazole), polyesters, polycarbonates, poly(vinyl chloride), polyacrylates and methacrylates, copolymers of vinyl chloride and vinyl acetate, phenolic resins, polyurethanes, poly(vinyl alcohol), polyacrylonitrile, polystyrene, and the like. It is desirable to select a coating solvent that does not substantially disturb or adversely affect the other previously coated layers of the device. Examples of coating solvents for the photogenerating layer are ketones, alcohols, aromatic hydrocarbons, halogenated aliphatic hydrocarbons, ethers, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The photogenerating layer may comprise amorphous films of selenium and alloys of selenium and arsenic, tellurium, germanium and the like, hydrogenated amorphous silicon and compounds of silicon and germanium, carbon, oxygen, nitrogen and the like fabricated by vacuum evaporation or deposition. The photogenerating layers may also comprise inorganic pigments of crystalline selenium and its alloys; Group II to VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos; and the like dispersed in a film forming polymeric binder and fabricated by solvent coating techniques; and a number of phthalocyanines, like a titanyl phthalocyanine, titanyl phthalocyanine Type V; oxyvanadium phthalocyanine, chloroaluminum phthalocyanine, copper phthalocyanine, oxytitanium phthalocyanine, chlorogallium phthalocyanine, hydroxygallium phthalocyanine magnesium phthalocyanine and metal free phthalocyanine and the like with infrared sensitivity photoreceptors exposed to low-cost semiconductor laser diode light exposure devices.

In embodiments, examples of polymeric binder materials that can be selected as the matrix for the photogenerating layer are illustrated in U.S. Pat. No. 3,121,006, the disclosure of which is totally incorporated herein by reference. Examples of binders are thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, poly (phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly(vinyl chloride), vinyl chloride and vinyl acetate copolymers, acrylate copolymers, alkyd resins, cellulosic film formers, poly(amideimide), styrenebutadiene copolymers, vinylidene chloride-vinyl chloride copolymers, vinyl acetate-vinylidene chloride copolymers, styrene-alkyd resins, poly(vinyl carbazole), and the like. These polymers may be block, random or alternating copolymers.

The coating of the photogenerating layer in embodiments of the present disclosure can be accomplished with spray, dip or wire-bar methods such that the final dry thickness of the photogenerating layer is as illustrated herein, and can be, for example, from about 0.01 to about 30 microns after being dried at, for example, about 40° C. to about 150° C. for about 15 to about 90 minutes. More specifically, photogenerating layer of a thickness, for example, of from about 0.1 to about 30, or from about 0.5 to about 2 microns can be applied to or deposited on the substrate, on other surfaces in between the substrate and the charge transport layer, and the lice. The photogenerating composition or pigment is present in the resinous binder composition in various amounts. From about 5 percent by volume to about 90 percent by volume of the photogenerating pigment is dispersed in about 10 percent by volume to about 95 percent by volume of the resinous binder, or from about 20 percent by volume to about 30 percent by volume of the photogenerating pigment is dispersed in about 70 percent by volume to about 80 percent by volume of the resinous binder composition. In one embodiment, about 10 percent by volume of the photogenerating pigment is dispersed in about 90 percent by volume of the resinous binder composition.

Various suitable and conventional known processes may be used to mix, and thereafter apply the photogenerating layer coating mixture, like spraying, dip coating, roll coating, wire wound rod coating, vacuum sublimation, and the like. For some applications, the photogenerating layer may be fabricated in a dot or line pattern. Removal of the solvent of a solvent-coated layer may be effected by any known conventional techniques such as oven drying, infrared radiation drying, air-drying and the like.

In embodiments, at least one charge transport layer is comprised of at least one hole transport component. The concentration of the hole transport component may be low to, for example, achieve increased mechanical strength and LCM resistance in the photoconductor. In embodiments the concentration of the hole transport component in the charge transport layer may be from about 10 weight percent to about 65 weight percent and more specifically from about 35 to about 60 weight percent, or from about 45 to about 55 weight percent.

The charge transport layer, such layer being generally of a thickness of from about 5 microns to about 90 microns, and more specifically, of a thickness of from about 10 microns to about 40 microns, may include a number of hole transport compounds, such as substituted aryl diamines and known hole transport molecules, as illustrated herein, and additional components, including additives, such as antioxidants, a number of polymer binders and the like. In embodiments, additives may include at least one additional binder polymer, such as from 1 to about 5 polymers in a percent weight range of about 10 to about 75 in the charge transport layer; at least one additional hole transport molecule, such as from 1 to about 7, 1 to about 4, or from 1 to about 2 in a percent weight range of about 10 to about 75 in the charge transport layer; antioxidants; like IRGONAX (available from Ciba Specialty Chemical), in a percent weight range of about 0 to about 20, from about 1 to about 10, or from about 3 to about 8 weight percent.

The charge transport layer may comprise hole transporting small molecules dissolved or molecularly dispersed in a film forming, electrically inert polymer such as a polycarbonate. In embodiments, "dissolved" refers, for example, to forming a solution in which the small molecule is dissolved in the polymer to form a homogeneous phase; and "molecularly dispersed in embodiments" refers, for example, to hole transporting molecules dispersed in the polymer, the small molecules being dispersed in the polymer on a molecular scale. Various hole transporting or electrically active small molecules may be selected for the charge transport layer. In embodiments, hole transport refers, for example, to hole transporting molecules as a monomer that allows the free charge generated in the photogenerating layer to be transported across the transport layer.

Examples of hole transporting molecules include, for example, pyrazolines such as 1-phenyl-3-(4'-diethylamino styryl)-5-(4"-diethylamino phenyl)pyrazoline; aryl amines such as N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine; hydrazones such as N-phenyl-N-methyl-3-(9-ethyl)carbazyl hydrazone and 4-diethyl amino benzaldehyde-1,2-diphenyl hydrazone; and oxadiazoles such as 2,5-bis(4-N,N'-diethylaminophenyl)-1,2,4-oxadiazole, stilbenes, and the like. However, in embodiments to minimize or avoid cycle-up in equipment, such as printers, with high throughput, the charge transport layer should be substantially free (less than about two percent) of di or triamino-triphenyl methane. A small molecule charge transporting compound that permits injection of holes into the photogenerating layer with high efficiency and transports them across the charge transport layer with short transit times includes N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine, tetra[p-tolyl] biphenyldiamine also referred to as N,N,N'N'-tetra(4-methylphenyl)-(1,1'-biphenyl)-4,4'-diamine; N,N,N'N'-tetra (4-ethylphenyl)-(1,1'-biphenyl)-4,4'-diamine; N,N,N'N'-tetra(4-propylphenyl)-(1,1'-biphenyl)-4,4'-diamine; N,N,N'N'-tetra(4-butylphenyl)-(1,1'-biphenyl)-4,4'-diamine, or mixtures thereof, and the like. If desired, the hole transport material in the charge transport layer may comprise a polymeric hole transport material or a combination of a small molecule hole transport material and a polymeric hole transport material.

Examples of the binder materials selected for the charge transport layer include components, such as those described in U.S. Pat. No. 3,121,006, the entire disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly (cyclo olefins), epoxies, and random or alternating copolymers thereof; and more specifically, polycarbonates such as poly(4,4'-isopropylidene-diphenylene)carbonate (also referred to as bisphenol-A-polycarbonate), poly(4,4'-cyclohexylidinediphenylene)carbonate (also referred to as bisphenol-Z-polycarbonate), poly(4,4'-isopropylidene-3,3'-dimethyl-diphenyl)carbonate (also referred to as bisphenol-C-polycarbonate), and the like. In embodiments, electrically inactive binders are comprised of polycarbonate resins with a molecular weight of from about 20,000 to about 100,000, such as a molecular weight $M_w$ of from about 50,000 to about 100,000. Generally, the transport layer contains from about 10 to about 75 percent by weight of the hole transport material, and more specifically, from about 35 percent to about 50 percent of this material.

The thickness of the charge transport layer in embodiments is from about 5 to about 90 micrometers, but thicknesses outside this range may in embodiments also be selected. The charge transport layer should be an insulator to the extent that an electrostatic charge placed on the hole transport layer is not conducted in the absence of illumination at a rate sufficient to prevent formation and retention of an electrostatic latent image thereon. In general, the ratio of the thickness of the charge transport layer to the photogenerating, layer can be from about 2:1 to 200:1, and in some instances 400:1. The charge transport layer is substantially nonabsorbing to visible light or radiation in the region of intended use, but is electrically "active" in that it allows the injection of photogenerated holes from the photoconductive layer, or photogenerating layer, and allows these holes to be transported through itself to selectively discharge a surface charge on the surface of the active layer.

A number of processes may be used to mix and thereafter apply the charge transport layer coating mixture to the photogenerating layer. Typical application techniques include spraying, dip coating, roll coating, wire wound rod coating, and the like. Drying of the charge transport deposited coating may be effected by any suitable conventional technique such as oven drying, infrared radiation drying, air drying, and the like.

An overcoat layer may be formed over the charge transport layer. This protective overcoat layer may increase the extrinsic life of a photoreceptor device and may maintain good printing quality or deletion resistance when used in an image forming apparatus.

The overcoat layer may comprise the same components as the charge transport layer wherein the weight ratio between the charge transporting small molecule and the suitable electrically inactive resin binder is less, such as for example, from about 0/100 to about 60/40, or from about 20/80 to about 40/60.

Alternatively, a protective overcoat layer may comprise a crosslinked polymer coating containing a charge transport component. Specific embodiments may include crosslinked polymer coatings formed from polysiloxanes, phenolic resins, melamine resins and the like, with a suitable charge transport component. An illustrative example of protective overcoats, such as U.S. patent application Ser. No. 11/234,275 (filed Sep. 26, 2005), may include a cured composition formed from (i) a polyol binder, (ii) a melamine-formaldehyde curing agent; (iii) a hole transport material; and (iv) an acid catalyst.

The thickness of the overcoat layer selected depends upon the abrasiveness of the charging (bias charging roll), cleaning (blade or web), development (brush), transfer (bias transfer roll), and the like in the system employed, and can be continuous and may have a thickness of less than about 50 micrometers, for example from about 0.1 micrometers to about 50 micrometers, for example from about 0.1 micrometers to about 15 micrometers. Various suitable and conventional methods may be used to mix, and thereafter apply the overcoat layer coating mixture to the photogenerating layer. Typical application techniques include spraying, dip coating, roll coating, wire wound rod coating, and the like. Drying of the deposited coating may be effected by any suitable conventional technique, such as oven drying, infrared radiation drying, air drying, and the like. The dried overcoating layer of this disclosure should transport holes during imaging and should not have too high a free carrier concentration. Free carrier concentration in the overcoat increases the dark decay.

In embodiments, any of the charge generating layer, charge transport layer, or protective overcoat layer may be the outermost layer 1 of the photoreceptor, and may comprise a lubricant 2 that is encapsulated in nanocapsules or microcapsules 3. In particular the charge generating layer may be the outermost layer of the photoreceptor and may comprise a lubricant that is encapsulated in nano- or microcapsules; the charge transport layer may be the outermost layer of the photoreceptor and may comprise a lubricant that is encapsulated in nano- or microcapsules; or the protective overcoat layer may be the outermost layer of the photoreceptor and may comprise a lubricant that is encapsulated in nano- or microcapsules. In the event of wear or cracking of the photoreceptor, the nano- or microcapsules 3 may be forced to rupture, thereby releasing the lubricant 2. The rupturing may occur, for example, by contact of exposed nano- or microcapsules on the surface layer with a cleaning blade or other conventional component of a development apparatus. Such lubricant will reduce the wear and friction that would otherwise damage the photoreceptor. The FIGURE illustrates a photoreceptor design concept that may address maintenance issues arising when the photoreceptor is in use, and repair issues in the event of damage.

References made herein in reference to microcapsules may also be applicable to nanocapsules, and references made herein in to nanocapsules may also be applicable to microcapsules. A microcapsule or nanocapsule described herein in general comprises a core material comprised of a lubricant, which is contained inside the capsules by a thin wall or shell.

Photoreceptors with lubricants offer tremendous potential for providing long-lived structural materials. In embodiments, a lubricant delivering coating may include lubricants suitable for use in photoreceptors, for example, synthetic lubricants; mineral lubricants; or natural lubricants. Mineral lubricants may include any mineral lubricant, such as mineral oil or liquid petrolatum, which is a by-product in the distillation of petroleum to produce gasoline. Petrolatum is a transparent, colorless oil composed mainly of alkanes (typically 15 to 40 carbons) and cyclic parafins, and is related to white petroleum. In essence, any inorganic material that could function as a lubricant may be used, for example, zinc stearate, or any other metal stearate, Natural lubricants may include lubricants extracted from natural products, such as vegetable oils and the like. Exemplary synthetic lubricants may be, for example, polymer materials such as polyolefins, polysiloxanes (also called silicone), fluorocarbons, fluoropolymers, and the like. Additionally, any liquid polymer suitable as a lubricant, including any phosphate containing compounds may be employed. Essentially, any Exemplary mineral lubricants may be, for example, petroleum based lubricants. Exemplary natural lubricants may be, for example, soybean oil, linseed oil, and the like.

The lubricants described herein may take any form, for example, lubricants may be wax, liquid, gel, powder, or any other form. The lubricant materials may also, for example, be present in microcapsules, comprise a portion of the microcapsule itself or be present in any layer of the photoreceptor.

Microcapsules may not only store the lubricant during quiescent states, but provide a mechanical trigger for the lubrication process when damage occurs in the host material and the capsules rupture. The addition of these microcapsules to an epoxy matrix, for example, may also provide a unique toughening mechanism for the composite system. Any microcapsule may be used that does not hinder or negatively impact the electrical performance of the photoreceptor.

The microcapsules may possess sufficient strength to remain intact during processing, yet rupture when the photoreceptor is damaged. In embodiments, the microcapsules may exhibit high bond strength to the photoreceptor materials, combined with a moderate strength microcapsule shell. In embodiments, the capsules may be impervious to leakage and diffusion of the encapsulated (liquid) lubricant for considerable time in order to, for example, extend shelf life. In embodiments, these combined characteristics can be achieved, for example, with a system based on capsules with a suitable wall comprised of urea-formaldehyde resins, melamine formaldehyde resins, polyesters, polyurethanes, polyamides and the like.

There is significant scientific and patent literature on micro- or nano-encapsulation techniques and processes. For example, microencapsulation is discussed in detail in "Microcapsule Processing and Technology" by Asaji Kondo, 1979, Marcel Dekker, Inc; "Microcapsules and Microencapsulation Techniques by Nuyes Data Corp., Park Ridge, N.J. 1976. Illustrative encapsulation includes chemical processes such as interfacial polymerization, in-situ polymerization, and matrix polymerization, and physical processes, such as centrifugal extrusion, phase separation, and core-shell encapsulation by vibration, and the like. Materials may be used for interfacial polymerization include, but not limited to, diacyl chlorides or isocyanates, in combination with di- or polyalcohols, amines, polyester polyols, polyurea, and polyurethans. Useful materials for in situ polymerization include, but not limited to, polyhydroxyamides, with aldehydes, melamine, or urea and formaldehyde, and the like.

In embodiments, the microcapsules are substantially spherical in shape and may have an average diameter of 1-1000 micrometers, such as from about 1 to about 100 microns, such as from about 0.2 to about 10 microns, or from about 0.5 to about 8 microns. Microcapsules may comprise from about 70% to about 95% by weight of lubricant, such as from about 83% to about 92% by weight, or other fill material. Microcapsules may thus comprise about 5% to about 30% by weight of the total aggregate weight of the microcapsule and its fill content, such as from about 8% to about 17%, or from about 1% to about 10%. Microcapsule shell wall thickness may be from about 20 nm to about 250 nm, for example, from about 160 nm to about 220 nm. Microcapsules in this range of shell thickness may be sufficiently robust to survive handling and manufacture, yet when embedded in an epoxy matrix, for example, the microcapsules may rupture and release their content at the site of damage. Nanoparticles of the microcapsule material may form on the surface of the microcapsules during production, thereby producing a rough surface morphology. Rough surface morphology may, for example, enhance mechanical adhesion when the microcapsules are embedded in a polymer, thus improving performance as a lubrication mechanism.

The following Examples are being submitted to illustrate embodiments of the present disclosure. These Examples are intended to be illustrative only, and are not intended to limit the scope of the present disclosure. Also, parts and percentages are by weight unless otherwise indicated. Comparative Examples and data are also provided.

EXAMPLES

Self lubricating layers of photoreceptors can be prepared by any conventional means or any other method obvious to those skilled in the art which would produce the desired overcoat layer.

An electrophotographic photoreceptor containing a self-lubricating, layer was fabricated in the following manner. A coating solution for an undercoat layer comprising 100 parts of a ziconium compound (trade name: Orgatics ZC540), 10 parts of a silane compound (trade name: A110, manufactured by Nippon Unicar Co., Ltd), 400 parts of isopropanol solution and 200 parts of butanol was prepared. The coating solution was applied onto a cylindrical aluminum (Al) substrate subjected to honing treatment by dip coating and dried by heating at 150° C. for 10 minutes to form an undercoat layer having a film thickness of 0.1 micrometer.

A 0.5 micron thick charge generating layer was subsequently dip coated on top of the undercoat layer from a dispersion of Type V hydroxygallium phthalocyanine (12 parts), alkylhydroxy gallium phthalocyanine (3 parts), and a vinyl chloride/vinyl acetate copolymer, VMCH (Mn=27,000, about 86 weight percent of vinyl chloride, about 13 weight percent of vinyl acetate and about 1 weight percent of maleic acid) available from Dow Chemical (10 parts), in 475 parts of n-butylacetate.

Subsequently, a 25 μm thick charge transport layer (CTL) was dip coated on top of the charge generating layer from a solution of N,N'-diphenyl-N,N'-bis(3-methylphenyl)-1,1'-biphenyl-4,4'-diamine (82.3 parts), 2.1 parts of 2,6-di-tert-butyl-4-methylphenol (BHT) from Aldrich and a polycarbonate, PCZ-400 [poly(4,4'-dihydroxy-diphenyl-1,1-cyclohexane), $M_w$=40,000] available from Mitsubishi Gas Chemical Company, Ltd, (123.5 parts) in a mixture of 546 parts of tetrahydrofuran (THF) and 234 parts of monochlorobenzene. The CTL was dried at 115° C. for 60 minutes.

On top of the charge transport layer, a self-lubricating overcoat layer was coated from a suspension comprising 1.5 parts of polyol (Joncryl 587, BASF, The Chemical Company), 2.4 parts of N,N'-diphenyl-N,N'-bis(3-hydroxyphenyl)-(1,1'-biphenyl)-4,4'-diamine as charge transport component, 2.1 parts of melamine resin (Cymel 303, Cytec Industries Inc.), 0.045 part of acid catalyst (Nacure 5225, King Industries Inc.), and 0.32 part of silicone oil capsules (average size: 5 microns, prepared by in situ polymerization from urea and formaldehyde) in 22 parts of Dowanol PM (Sigma Aldrich), followed by thermal curing at 140° C. for 40 minutes to form an overcoat layer having a film thickness of 5 μm. The resulted overcoat resin layer contained about 5 weight percent of the encapsulated silicone lubricant.

A Comparative Example photoreceptor or photoconductor was prepared by repeating the above process except that the overcoat layer was applied without the silicone capsules.

Evaluation of Photoreceptor Performance Properties:

The electrical performance characteristics of the above prepared photoreceptors such as electrophotographic sensitivity and short term cycling stability were tested in a scanner. The scanner is known in the industry and equipped with means to rotate the drum while it is electrically charged and discharged. The charge on the photoconductor sample is monitored through use of electrostatic probes placed at precise positions around the circumference of the device. The photoreceptor devices are charged to a negative potential of 500 Volts. As the devices rotate, the initial charging potentials are measured by voltage probe 1. The photoconductor samples are then exposed to monochromatic radiation of known intensity, and the surface potential measured by voltage probes 2 and 3. Finally, the samples are exposed to an erase lamp of appropriate intensity and wavelength and any residual potential is measure by voltage probe 4. The process is repeated under the control of the scanner's computer, and the data is stored in the computer. The PIDC (photo induced discharge curve) is obtained by plotting the potentials at voltage probes 2 and 3 as a function of the light energy. The photoreceptor having the self-lubricating overcoat layer showed comparable PIDC characteristics as the control or Comparative Example device.

The electrical cycling performance of the photoreceptor was performed using a in-house fixture similar to a xerographic system. The photoreceptor device with the overcoat showed stable cycling of over 170,000 cycles in a humid environment (28° C., 80% RH).

The torque properties, measured in Newton-meter, of the photoreceptor are measured in the following manner. A photoreceptor was placed in a xerographic customer replaceable unit (CRU), as is used in a DC555 (manufactured by Xerox Corporation). The average of the torque was measured at six seconds of rotation of the photoreceptor devices. The photoreceptor with the self-lubricating overcoat layer disclosed herein possessed a torque value of 0.7 Newton-meter, which was about 25% lower than the comparative example device.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A photoconductive member comprised of a lubricant delivering coating comprising a polymer matrix, a charge transport component, and a lubricant encapsulated within nano- or microcapsules, wherein the lubricant is a liquid or a semisolid encapsulated with a thin shell.

2. The photoconductive member of claim 1, wherein the lubricant selected from the group consisting of synthetic lubricants, mineral lubricants, and natural lubricants.

3. The photoconductive member of claim 1, wherein the lubricant is selected from the group consisting of paraffin, polyolefins, esters, vegsilicone, fluorocarbons, and fluoropolymers, and vegetable oils.

4. The photoconductive member of claim 1, wherein the lubricant is selected from polysiloxanes selected from the group consisting of polydimethlsiloxanes, poly(dimethylsiloxane-co-trifluoropropylmethylsiloxane), and polydimethysiloxane grafted with or terminated with a perfluoroalkyl group having from 1 to about 30 carbons.

5. The photoconductive member of claim 1, wherein the lubricant comprises perfluoropolyethers selected from the group consisting of poly(difluoromethylene oxide), poly(tetrafluoroethylene oxide), poly(hexafluoropropylene oxide), poly(tetrafluoro-ethylene oxide-co-difluoromethylene oxide), poly(hexafluoropropylene oxide-co-difluoromethylene oxide), and poly(tetrafluoroethylene oxide-co-hexafluoropropylene oxide-co-difluoromethylene oxide).

6. The photoconductive member of claim 1, wherein the microcapsules comprise a shell formed from a polymeric material selected from the group consisting of urea-formaldehyde resins, melamine formaldehyde resins, polyesters, and polyurethanes.

7. The photoconductive member of claim 1, wherein the polymer shell is comprised of urea-formaldehyde resin.

8. The photoconductive member of claim 1, wherein the microcapsules comprise a shell having a shell wall thickness of from about 20 nm to about 250 nm.

9. The photoconductive member of claim 1, wherein the microcapsules comprise a shell having a shell diameter of from about 0.2 to about 20 micrometers.

10. The photoconductive member of claim 1, wherein the microcapsules comprise a shell having a shell diameter of from about 0.5 to about 10 micrometers.

11. The photoconductive member of claim 1, wherein the capsules are present from about 1% to about 10% by volume of entire coating.

12. The photoconductive member of claim 1, wherein the lubricant delivering coating further contains a photosensitive pigment.

13. The photoconductive member of claim 1, further comprising a substrate and a charge generating layer, wherein the lubricant delivering coating is positioned on top of said charge generating layer.

14. The photoconductive member of claim 13, wherein the charge generating layer comprises a photosensitive pigment selected from the group consisting of a perylene pigment, an azo pigment, and a phthalocyanine pigment; and the lubricant delivering coating comprises a polymer matrix comprised of an aromatic polycarbonate or polyarylate, a charge transport component comprised of a tertiary arylamine, and a lubricant encapsulated within nano- or microcapsules.

15. The photoconductive member of claim 13, wherein the charge generating layer comprises a photosensitive pigment selected from the group consisting of a metal free phthalocyanine, a hydroxygallium phthalocyanine, a chlorogallium phthalocyanine, and a titanium oxide phthalocyanine; and the lubricant delivering coating comprises a polymer matrix comprised of an aromatic polycarbonate or polyarylate, a charge transport component selected from the group consisting of N,N'-diphenyl-N,N'-bis(3-methylphenyl)-(1,1'-biphenyl)-4,4'-diamine, N,N,N'N'-tetra(4-methylphenyl)-(1,1'-biphenyl)-4,4'-diamine, N,N'-bis(4-butylphenyl)-N,N'-di-p-tolyl-[p-terphenyl]-4,4"-diamine, and N,N-bis(4-butylphenyl)-N,N'-di-m-tolyl-[p-terphenyl]-4,4"-diamine, and a lubricant encapsulated within nano- or microcapsules.

16. The photoconductive member of claim 1, further comprising a substrate, a charge generating layer, and a charge transport layer, wherein the lubricant delivering coating is positioned on top of said charge transport layer.

17. The photoconductive member of claim 16, wherein the charge generating layer comprises a photosensitive pigment selected from the group consisting of a perylene pigment, an azo pigment, and a phthalocyanine pigment; wherein a charge transport layer comprises a polymer and a hole transport compound comprised of a tertiary arylamine; and wherein the lubricant delivering coating layer comprises a crosslinked charge transport resin and a lubricant encapsulated within nano- or microcapsules.

18. The photoconductive member of claim 17, wherein said photosensitive pigment is selected from the group consisting of a metal free phthalocyanine, a hydroxygallium phthalocyanine, a chlorogallium phthalocyanine, and a titanium oxide phthalocyanine; said hole transport compound is selected from the group consisting of N,N'-diphenyl-N,N'-bis(3-methylphenyl)-(1,1'-biphenyl)-4,4'-diamine, N,N,N'N'-tetra(4-methylphenyl)-(1,1'-biphenyl)-4,4'-diamine, N,N'-bis(4-butylphenyl)-N,N'-di-p-tolyl-[p-terphenyl]-4,4"-diamine, and N,N'-bis(4-butylphenyl)-N,N'-di-m-tolyl-[p-terphenyl]-4,4"-diamine; and wherein said crosslinked charge transport resin is formed from a reactive charge transport compound comprised of a tertiary arylamine, an optional polyol binder, and a curing agent of a melamine-formaldehyde resin or a guamine-formaldehyde resin.

* * * * *